United States Patent [19]

Staudinger et al.

[11] 4,054,424

[45] Oct. 18, 1977

[54] PROCESS FOR QUENCHING PRODUCT GAS OF SLAGGING COAL GASIFIER

[75] Inventors: Gernot Staudinger, Amsterdam; Maarten J. van der Burgt, The Hague, both of Netherlands

[73] Assignee: Shell Internationale Research Maatschappij B.V., Netherlands

[21] Appl. No.: 583,966

[22] Filed: June 5, 1975

[30] Foreign Application Priority Data

June 17, 1974 Netherlands ..... 7408036

[51] Int. Cl.[2] ..... C10J 3/46; C10J 3/84

[52] U.S. Cl. ..... 48/210; 23/277 C; 34/13; 34/57 R; 48/19 TR; 48/DIG. 2; 110/119; 261/17; 261/79 A; 261/DIG. 54; 261/DIG. 76; 55/83; 55/261

[58] Field of Search ..... 48/DIG. 2, 197 R, 87, 48/180 R, 180 L, 180 M, 210, 206; 261/DIG. 54, DIG. 76, 17, 79 A; 55/263, 83, 261; 259/4, 18; 110/119, 1 K; 34/13, 22, 57 R, 57 A, 57 B; 23/277 C

[56] References Cited

U.S. PATENT DOCUMENTS

| | | | |
|---|---|---|---|
| 2,302,396 | 11/1942 | Smith | 48/87 |
| 2,699,384 | 1/1955 | Peery et al. | 48/206 |
| 2,716,598 | 8/1955 | Moses | 48/206 |
| 2,905,544 | 9/1959 | Totzek | 48/DIG. 2 |
| 2,971,830 | 2/1961 | Kawai et al. | 48/206 |
| 3,495,384 | 2/1970 | Alliger | 261/17 |
| 3,567,399 | 3/1971 | Altmann et al. | 23/277 C |
| 3,715,301 | 2/1973 | Tassoney et al. | 48/197 R |
| 3,841,061 | 10/1974 | Pike | 261/DIG. 54 |
| 3,864,100 | 2/1975 | Blaskowski | 48/197 R |

*Primary Examiner*—S. Leon Bashore
*Assistant Examiner*—Peter F. Kratz
*Attorney, Agent, or Firm*—Pravel, Wilson & Gambrell

[57] ABSTRACT

A process is disclosed for quenching of the partial combustion product gas of a slagging coal gasifier containing suspended molten slag particles wherein the hot product gas of the gasifier is passed through a tubular quench zone into which a shielding gas is introduced circumferentially to form an annular layer or protective gas shield between the product gas and the walls of the quench zone and a cooling gas is injected radially to effect direct cooling of the product gas to a temperature at which the molten slag particles solidify and lose their stickiness, said protective gas shield being maintained for a sufficient distance along the axis of the quench zone to prevent contact between the quench zone walls and the hot product gas during said cooling.

13 Claims, 1 Drawing Figure

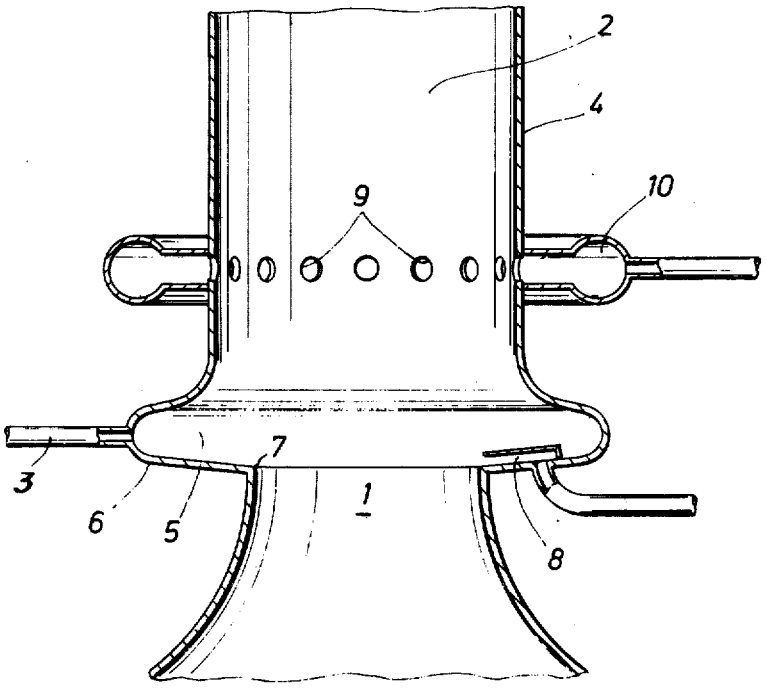
2
4
9
10
3
7
6
5
1
8

PROCESS FOR QUENCHING PRODUCT GAS OF SLAGGING COAL GASIFIER

BACKGROUND OF THE INVENTION

This invention relates to an improved method for cooling the hot product gas obtained when coal is partially combusted in a conventional slagging coal gasifier. More particularly, this invention is directed to a process for direct quenching of the hot product gas of a slagging coal gasifier in a tubular quench zone whereby deposition of sticky, molten slag particles, typically dispersed in such product gases, on the quench zone walls is minimized or avoided during the period before the slag particles become sufficiently cooled to lose their stickiness.

The partial combustion or gasification of solid carbon-containing fuels such as coal to produce gases having valve as residential and industrial fuels, as starting materials for synthesis of chemicals and fuels and as an energy source for generations of electricity has long been recognized and practiced on varying scales throughout the world. In the case of coal gasification, a number of different gasification processes have been developed to take into account factors such as the coal source employed, the gasifying medium used and the use sought to be made of the product gas. While these processes may be classified in a variety of ways, they generally fall into two distinct groups with respect to the condition in which the non-carbonaceous, mineral residue is removed from the gasification zone, i.e., dry ash in a nonslagging operation or slag in a slagging operation. These two different process groupings derive primarily from the temperatures employed in the gasification zone itself — i.e., the nonslagging gasifiers are operated at reaction temperatures, usually less than 1400° C, below those at which the contained ash will fuse while the temperatures employed in slagging gasifiers are sufficient, usually 1500–2700° C, to convert the dry ash into a molten slag. Though advantages exist for gasification processes falling into each group, the processes employing slagging coal gasifiers are generally considered to be the most flexible at least in terms of the variety of coal feedstocks which can be suitably employed. That is, operation of coal gasifiers under nonslagging conditions is generally limited to weakly coking coals of low ash content because of the difficulty in removing ash with grates and other mechanical devices whereas in operation at slagging conditions, almost any coal can be suitably employed since the ash becomes a free-flowing fluid under slagging conditions and, as a result, is quite simply and easily removed from the gasifier. A good general review of a variety of coal gasification processes appears in the Kirk-Othmer Encyclopedia of Chemical Technology, 2nd Ed., Vol. 10, pp. 353–388, Interscience (1966).

One process employing a slagging coal gasifier which has had rather wide application is the Koppers-Totzek process. This process which is described in an article by F. Totzek in "Brennstoff-Chemie," Vol. 34, pp. 361–367 (1953), has the capability of handling just about any coal including lignites with up to 30% ash or mineral contents. While a significant portion of the molten slag is removed at the bottom of the gasifier, the product gas of this process like other processes employing slagging gasifiers still contains a significant quantity of mineral matter in the form of a suspension or mist of molten or partly molten particles.

Primarily because of the impure nature of the mineral matter in typical coals, being mixtures of silica and various metal oxides, the molten or partly molten slag will not have a specific melting point but rather will solidify over a melting range which may cover many hundreds of degrees. Thus, since it is usually necessary to cool the coal gasifier effluent prior to further processing, the molten or partly molten slag contained therein is or can become sticky, at least temporarily, on cooling. In a typical application, the gas leaving the reactor has a temperature, as a rule higher than 1400° C, at which the ash is quite fluid. For further processing, this crude product gas has to be cooled down to a temperature, for example 300° C, through a rather broad range of temperatures at which the slag is sticky, i.e, slag from coal usually being sticky in the temperature range of 1500 -900° C. When the slag particles are no longer sticky, they can be easily removed by known techniques such as cyclones, bind separators, filters or similar devices. However, in the transition between being highly fluid molten liquid and solid nonsticky particles, these slag particles exhibit sufficient stickiness that they can cause extreme difficulties in processing by adhering to and forming deposits on walls, valves, outlets, etc., of process equipment immediately downstream of the gasifier. These deposits tend to build up and as a result interfere with good operation of the process and even lead to complete blocking. Accordingly, the instant invention provides a process for cooling down the product gas of a slagging coal gasifier in which the harmful effects of the stickiness of molten slag particles contained therein is minimized and even completely eliminated.

SUMMARY OF THE INVENTION

It has now been found that the hot partial combustion product gas emerging from a slagging coal gasifier can be effectively quenched — i.e., cooled to a temperature at which the suspended slag particles contained therein are no longer sticky — without deposition or build up of sticky slag particles on the process eiquipment downstream of the gasifier. In this improved quench process the hot product gas is cooled directly by admixture with a cooling gas in a tubular quench zone near the entrance of which a particle-free shielding gas is introduced in such a way that a protective gas shield is formed against the wall of the said zone, which shield prevents the hot product gas from coming into contact with the wall of the zone, while in that zone at the same time the cooling gas is added to the hot product gas.

Accordingly, the instant invention provides a process for quenching of the partial combustion product gas of a slagging coal gasifier containing suspended molten, sticky slag particles to a temperature at which the slag particles are no longer sticky which comprises:

a. passing the hot partial combustion product gas into a tubular quench zone;
b. introducing into said quench zone a cooling gas which is injected radially to effect admixture with, and direct quenching of, the hot product gas and
c. introducing circumferentially into said quench zone, at its inlet end, a particle-free shielding gas thereby forming an annular layer between the product gas and the quench zone walls, said annular layer being maintained for a sufficient distance along the axis of the quench zone to prevent contact between the quench zone walls and the hot product gas during quenching.

DESCRIPTION OF THE PREFERRED EMBODIMENTS

The process of the invention is applicable to the quenching of the gas effluent of any conventional slagging coal gasifier whether it be fixed or fluidized bed, fully entrained suspension or otherwise operated under atmospheric or superatmospheric conditions with the only proviso being that the product gas contain some mineral matter in the form of molten or partly molten particles. The coal feedstocks employed in such conventional processes generally encompass any coal available in commercial quantities including anthracite, bituminous, sub-bituminous and lignite having mineral contents ranging from less than 5% up to 30% of more. Especially preferred are the high-ash lignites and sub-bituminous coals since their high mineral contents can cause the greatest slag deposition problems in gasifiers operated under slagging conditions. In general, these slagging coal gasifiers are operated under partial combustion conditions to yield CO, $H_2$ and $CO_2$ as the principal gaseous products with methane, water vapor and nitrogen also being present in certain cases; the latter two components being especially prevalent when steam, air or oxygen-enriched air are employed in the gasifying medium. When operated under slag-forming conditions, the product gas emanating from the gasifier will generally be at a temperature of higher than 1400° C and contain a suspension or fine mist of molten or partly molten mineral slag particles.

According to the invention, this hot gas product is cooled by direct mixing with a coaling gas in a tubular quench zone whose walls are shielded with an annular layer or protective shield of a particle-free shielding during the quenching process. The cooling of a gas by intimate mixing with a gas at a lower temperature is very effective and involves no delay. Cooling can thus be rapidly effected in a relatively small space. This has great advantages, because the temperature range in which the slag particles are sticky is passed through rapidly, so that the hot product gas cooling zone can be small. Besides, the protective gas shield then needs to be maintained only in that small area. The quantity of cooling gas required naturally depends on the desired degree of cooling, on the nature and the temperature of the cooling gas, the temperature of hot product gas and the nature of the slag particles. A good shielding effect is obtained when the volume ratio between the flow of circumferentially injected shielding gas and hot product gas is at least 0.1 in a tubular quench zone. Generally, this ratio will not be chose n to be greater than 1.0, bearing in mind that it is desirable for the axial velocities of product gas and shielding gas to be about equal. This will prevent instability of the gas shield.

The shielding gas and the cooling gas may be any gas that can be mixed with the product gas without adversely effecting its quality for the desired use. The two gases need not be the same. It may be advantageous for the shielding gas and/or the cooling gas to consist at least partly of steam. Steam can easily be removed by condensation. Addition of steam may also be desirable to effect chemical conversion of certain constituents, if present, of the product gas, e.g., soot, methane, into carbon monoxide and hydrogen. An additional favorable effect is that these endothermic processes, causing the product gas to be cooled down. This may be achieved by adding oil and/or soot and/or coal to the cooling gas. In the case of oil, cracking thereof occurs. Soot and coal can react with steam or with carbon dioxide. For optimum results, the shielding gas should be particle free. Thus, it is convenient for at least part of the shielding gas and/or cooling gas to consist of particle-free product gas. Product gas that has passed through the tubular zone has cooled to such an extent that sticky molten slag particles have solidified. These particles can then easily be removed, as stated hereinbefore. A side stream of this particle-free gas can very suitably be used as the source of shielding and/or cooling gas. It is often desirable, at least in the vicinity of outlets for gases that are passed into the tubular zone, for the shielding gas to have such a high temperature that high fluidity renders the deposition of sticky slag particles impossible. For slag-containing gases this temperature may be higher than 1500° C. One method of accomplishing this is to introduce oxygen or a gas containing oxygen near the entrance of the tubular zone. Combustible components of the shielding gas will be combusted and thus raise the temperature of the gas in a small area at the desired location. The shielding gas introduced may have a much lower temperature. This is an advantage, because the shielding gas is gradually mixed with the product gas in any case. The shielding gas then contributes to the cooling of the product gas to the ultimate temperature desired.

Another suitable possibility is drawing the shielding gas and/or the cooling gas from a separate unit in which feed containing hydrocarbons is at least partially combusted. As a rule, the part to be used as cooling gas will have to be cooled while the part to be used as shielding gas can advantageously be employed without cooling.

The shielding gas can be introduced circumferentially into the tubular quench zone in various ways. A stable annular layer of gas against the quench zone walls or gas shield is obtained when the shielding gas is introduced with a tangentially directed velocity component. In this way, an intimate contact is achieved between shielding gas and wall. If required, the shielding gas may be introduced at more than one place spaced lengthwise along the tubular zone. In cases where the hot product gas of gasification enters the tubular quench zone at conventional flow rates, e.g., about 4 to about 50 kg/sec, it is preferred that the protective gas shield have a length taken along the axis of the quench zone of about 2 to 3 times the diameter of the quench zone, provided the gas shield of this length has sufficient integrity to prevent impingement of slag particles on the quench zone wall. In the case of quenching the hot gas product of a slagging coal gasifier having a temperature greater than 1400° C, this protective gas shield or annular layer of gas will exist along the axis of the quench zone until the temperature of the hot gas product and entrained slag is reduced to about 900° C.

The shielding gas is most suitably introduced circumferentially, via a tangential velocity component, at the entrance or upstream end of the quench zone. The cooling gas can be introduced slightly upstream of, at the same point of downstream of the area at which the shielding gas is introduced. Preferably, the cooling gas is introduced downstream of the point at which the shielding gas is introduced. This cooling gas is quite suitably introduced through radially directed outlets located at about the same height and equally spaced around the circumference of the tubular zone. Thus, the cooling gas is introduced into the hot product gas in the form of gas jets through the shielding gas. This will cause little disturbance in the shielding gas. In addition, cooling gas outlets are not located in the stream of hot product gas containing sticky slag particles, so that fouling of the outlets is prevented. By introducing in the vicinity of these outlets a shielding gas of a high temperature, or oxygen, or a gas containing oxygen, such a high temperature is reached in the immediate surroundings of those outlets that no sticky particles can ever be deposited, even if some product gas should locally penetrate to the wall. In most applications the volume ratio of hot product gas to cooling gas is suitably from 1:0.5 to 1:3.0 with ratios of about 1:1 being preferred.

The diameter of the radially directed cooling gas outlets is chosen such that, regard being had to the quantity of cooling gas to be introduced, that gas jets are so strong that they can reach center of the tubular zone. Stable gas jets are obtained at a linear gas velocity of 5–30 m/s. It is advantageous to use two kinds of outlets, each with a different diameter. Here, too, equal spacing of each kind around the circumference is preferred. Thus, gas jets are obtained with two different velocities, those emerging from the large outlets having the greater penetrating power. In this way, the cooling gas will have better contact with the mass of product present in a cross-section of the tubular zone.

The ratio of the diameters of these two different sized cooling gas outlets may be 1.2 to 1.5. The cooling gas is preferably introduced close to and downstream of the inlet of the shielding gas, since the gas shield is most effective where the shield is formed. The product gas is in contact with the shielding gas, which causes mixing to occur, as a result of which the gas shield will gradually become thinner and will finally disappear. It is, therefore, important that within the area where the gas shield is effective, the cooling of the product gas has progressed to the stage where the slag particles are no longer sticky.

The tubular quench zone suitable for use in the process according to the invention comprises a tube that can be connected to a source of the hot product gas to be cooled, which tube is provided with an annular gas inlet located in the vicinity of that connection, which inlet is provided with means to give that gas a rotary or tangential motion in the annular inlet, the tube further being provided with two or more inlets for a gas in a radial direction, which inlets are equally spaced around the circumference of the tube near and beyond the said annular inlet.

The invention will now be further elucidated with the aid of the figure which is a schematic representation of a suitable quench zone according to the invention.

Referring now to the figure, joint 1, forms part of the connection between a slagging coal gasification reactor located under this joint, but not shown in the figure, and a tubular quench zone 2. In this example, the reactor can be used particularly for the gasification of lignite coal. The gas so produced has a temperature of 1600° C and consists mainly of CO and $H_2$ and further contains $CO_2$, $H_2O$ and possibly $N_2$, as well as the finely dispersed molten slag particles. These particles are thinly liquid at 1600° C. If they are deposited on the wall of the tube leading upward to joint 1, the liquid film flows downward.

As seen in the figure, the annular shielding gas introduction zone 5 is formed in the wall 4 of the tubular quench zone 2 near the end of joint 1 via a shielding gas introduction pipe or duct 3; the annular shielding gas introduction zone 5 is accordingly supplied with a shielding gas which is rotating with a tangentially directed velocity component in the annular shielding gas introduction zone 5. This gas forms a gas shield agaist wall 4 of the tubular quench zone. There may be several shielding gas introduction ducts 3 at different heights. The bottom 6 of shielding gas introduction zone preferably has a slope of at least 10° to prevent the inflow of slag.

It is important for the rim 7 of the joint 1 to remain sufficiently hot to keep any slag thinly liquid. To this end there may be an auxiliary line 8 through which oxygen or a gas containing oxygen is introduced. Combustible components of the shielding gas from shielding gas introduction duct 3 will then be oxidized and raise the temperature locally.

Through ports 9 in wall 4, which are connected to a ring line 10, cooling gas is supplied. This cooling gas penetrates into the product gas in the form of gas jets. Ports 9 may have different diameters and are equally spaced around the circumference wall 4.

The product gas is cooled by this cooling gas to a temperature below 900° C, at which the slag particles have lost their stickiness. The can then be removed in a way not further specified by well-known techniques.

What is claimed is:

1. A process for quenching of the partial combustion product gas of a slagging coal gasifier containing suspended molten, sticky slag particles to a temperature at which the slag particles are no longer sticky which comprises:

a. passing the hot partial combustion product gas into a tubular quench zone;

b. introducing into said quench zone a cooling gas which is injected radially to effect admixture with, and direct quenching of, the hot product gas and c. introducing circumferentially into said quench zone, at its inlet end, a particle-free shielding gas thereby forming an annular layer between the product gas and the quench zone walls, said annular layer being maintained for a sufficient distance along the axis of the quench zone to prevent contact between the quench zone walls and the hot product gas prior to quenching.

2. The process according to claim 1, wherein the volume ratio between the flow of particle-free shielding gas and hot product gas to the quench zone is at least 0.1.

3. The process according to claim 2, wherein the axial velocities of the product gas and the shielding gas are about equal.

4. The process according to claim 3, wherein the shielding gas and/or the cooling gas consist at least partly of steam.

5. The process according to claim 3, wherein the shielding gas and/or the cooling gas consist at least partly of the product gas of the slagging coal gasifier, said product gas having been freed of entrained particles.

6. The process of claim 3, wherein the annular layer formed by the shielding gas extends along the axis of the quench zone for a distance of about 2 to 3 times the quench zone diameter.

7. The process according to claim 1, wherein the cooling gas is introduced immediately downstream of the point in the quench zone at which the shielding gas is introduced.

8. The process according to claim 7, wherein the volume ratio between the flow of hot product gas and cooling gas ranges from 1:0.5 to 1:3.0.

9. The process according to claim 8, wherein the volume ratio between the flow of cooling gas and hot product gas is about 1:1.

10. The process according to claim 7, wherein the cooling gas is introduced through radially directed outlets located at about the same axial distance from the quench zone entrance and spaced equally around the circumference of the tubular quench zone.

11. The process according to claim 10, wherein the cooling gas outlets are of two different diameters such that the cooling gas injected radially through the large diameter outlets penetrates to the center of the hot product gas flow and the cooling gas injected through the smaller diameter outlets penetrates a lesser distance thereby facilitating contact of the hot product gas and the cooling gas over the entire cross-section of the quench zone.

12. The process according to claim 11, wherein the cooling gas is injected at a linear velocity ranging from 5 to 30 m/sec.

13. The process according to claim 12, wherein the ratio of the diameters of the two different sized cooling gas outlets ranges from 1.2 to 1.5.

* * * * *